US007272336B1

(12) United States Patent
Dawson et al.

(10) Patent No.: US 7,272,336 B1
(45) Date of Patent: Sep. 18, 2007

(54) CARTRIDGE WITH A MOVABLE ELECTRICAL CONNECTOR FOR USE WITH AN IMAGE FORMING DEVICE

(75) Inventors: Jedediah Taylor Dawson, Lexington, KY (US); Akash Chaudhuri, Lexington, KY (US); Darin M. Gettelfinger, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 11/625,525

(22) Filed: Jan. 22, 2007

Related U.S. Application Data

(63) Continuation of application No. 11/554,157, filed on Oct. 30, 2006.

(51) Int. Cl.
*G03G 15/00* (2006.01)
*G03G 15/08* (2006.01)

(52) U.S. Cl. ..... 399/90; 399/119; 439/248; 439/357

(58) Field of Classification Search ..... 399/90, 399/119, 111, 262, 12, 13; 439/76.1, 660, 439/59, 247, 248, 357
See application file for complete search history.

(56) References Cited

U.S. PATENT DOCUMENTS 4,824,388 A 4/1989 Pickel
4,839,691 A 6/1989 Tagawa et al.
4,891,017 A 1/1990 Kuhn et al.
5,002,497 A 3/1991 Plocek et al.
5,259,779 A 11/1993 Ooya et al.
5,392,371 A 2/1995 Morlion et al.
5,490,802 A * 2/1996 Plyler et al.
5,605,150 A 2/1997 Radons et al.
5,746,617 A 5/1998 Porter, Jr. et al.
5,946,531 A * 8/1999 Miura et al. ..... 399/111
6,014,533 A 1/2000 Kawana
6,097,908 A 8/2000 Uchiyama et al.
6,168,262 B1 * 1/2001 Clark et al.
6,186,809 B1 2/2001 Kung
6,254,408 B1 7/2001 Hattori et al.
6,349,182 B2 2/2002 Otsubo et al.
6,582,039 B2 * 6/2003 Johnson et al.
6,773,283 B2 8/2004 Yoshimatsu et al.
6,786,750 B2 9/2004 Itoh
6,848,925 B2 * 2/2005 Nishide ..... 439/247
2003/0035016 A1 * 2/2003 Tanaka

* cited by examiner

*Primary Examiner*—Susan Lee
(74) *Attorney, Agent, or Firm*—Coats & Bennett, P.L.L.C.

(57) ABSTRACT

The present application is directed to toner cartridges for use with an image forming device. The toner cartridges may include a body with an interior reservoir that contains toner. The toner cartridges are removable from the image forming device and may be replaced, such as upon depletion of the toner from the interior reservoir. The cartridges include an electrical connector for connection to the main body. The electrical connector is movable relative to the body to facilitate engagement of the cartridge with the image forming device.

9 Claims, 10 Drawing Sheets

CARTRIDGE WITH A MOVABLE ELECTRICAL CONNECTOR FOR USE WITH AN IMAGE FORMING DEVICE

RELATED APPLICATION

The present application is a continuation of U.S. patent application Ser. No. 11/554,157 filed on Oct. 30, 2006.

BACKGROUND

The present application is directed to a cartridge for use with an image forming device and, more particularly, to a cartridge with a connector that is movable relative to the body of the cartridge for connecting with the image forming device.

Laser image forming devices include one or more photoconductive members that are generally cylindrical with a smooth surface. The photoconductive members receive a uniform electrostatic charge over the surface and rotate past a scanning laser that locally discharges the photoconductive member to form an electrostatic latent image representative of the outputted image.

Toner is originally stored within removable cartridges. The cartridges are connected to the device such that the toner can be moved to develop the latent image formed on the photoconductive member. Electrostatic forces attract the toner to the areas of the photoconductive members that have been discharged by the scanning laser. The toner images formed on the photoconductive members are then transferred either directly or indirectly to a media sheet. A mono-color image may be formed by a single toner layer that is transferred to the media sheet. A multi-color image may be formed by two or more toner layers of different colors that are transferred in an overlapping arrangement to the media sheet. Ultimately, the toner is fused to the media sheet to form the final printed sheet.

The cartridges are removable from the image forming device and may be replaced as necessary, such as upon depletion of the toner. The cartridges should include an electrical connection to engage and/or communicate with the image forming device upon insertion of the cartridge into the device. The electrical connection should be constructed to facilitate the connection between the cartridge and the device.

SUMMARY

The present application is directed to cartridges for use in image forming devices. The cartridges may include a body with a reservoir to contain toner. An electrical connector may be connected to the body to engage with the image forming device. The electrical connector forms a communication path between the cartridge and the image forming device. The electrical connector may be movable relative to the body to facilitate engagement when the cartridge is connected with the image forming device.

DETAILED DESCRIPTION

The present application is directed to toner cartridges for use with an image forming device. The toner cartridges may include a body with an interior reservoir to contain toner. The toner cartridges are removable from the image forming device and may be replaced, such as upon depletion of the toner from the interior reservoir. The cartridges include an electrical connector for connecting to the image forming device. The electrical connector is movable relative to the body to facilitate engagement of the cartridge with the image forming device.

Figure 1:
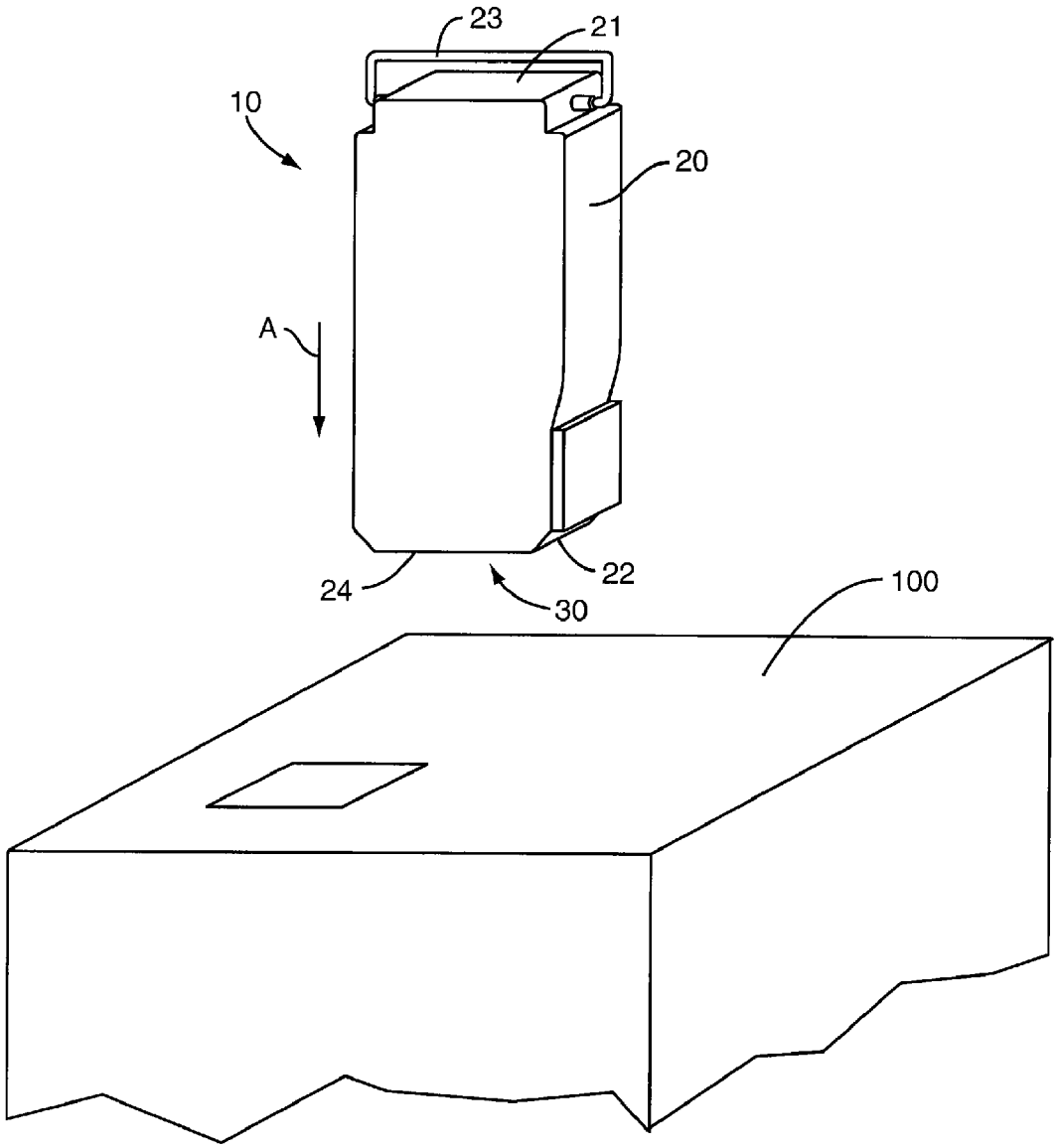
FIG. 1 is a schematic view of a cartridge according to one embodiment.
Figure 2:
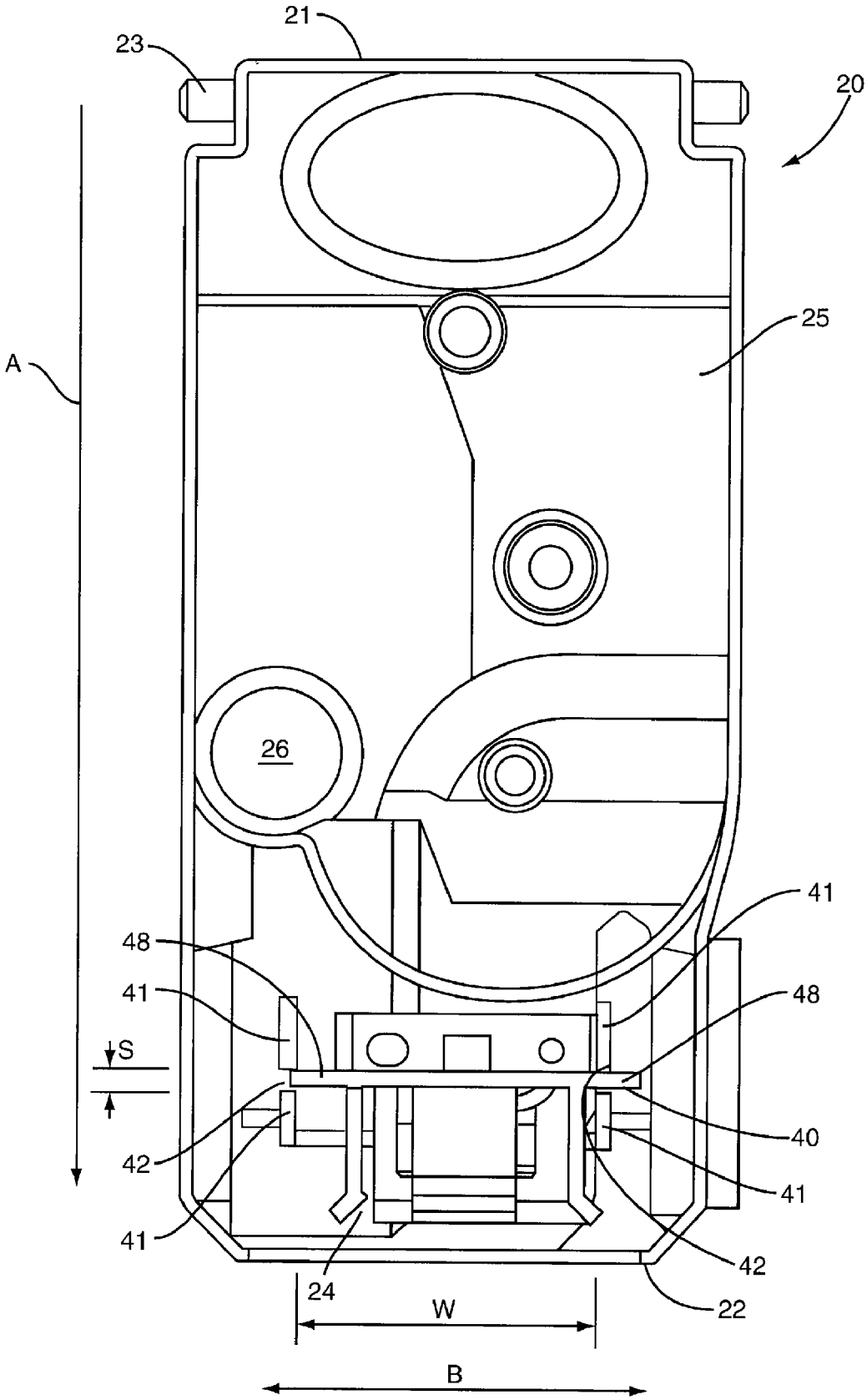
FIG. 2 is a cut-away side view of a cartridge according to one embodiment.

FIG. 1 illustrates a perspective view and FIG. 2 a sectional view of one embodiment of a cartridge 10. Cartridge 10 generally includes a body 20 with a reservoir 25 to contain toner. An electrical connector 30 is connected to the body 20 to form a communication path between the cartridge 10 and the image forming device 100. The electrical connector 30 is movable relative to the body 20 to facilitate engagement when the cartridge 10 is connected with the image forming device 100.

The body 20 generally includes a top side 21 and a bottom side 22. The top side 21 may include a handle 23 that is extendable from the body 20. The handle 23 is sized and positioned to be grasped by the user during insertion and removal of the cartridge 20 from the image forming device 100. The bottom side 22 may include a cavity 24 that is sized to contain the electrical connector 30. The cavity 24 may be sized to entirely contain the electrical connector 30 as illustrated in FIGS. 1 and 2, or partially contain the electrical connector 30 with a lower edge of the connector 30 extending outward beyond the bottom side 22 of the body 20.

The reservoir 25 is positioned between the top and bottom sides 21, 22. An outlet 26 leads from the reservoir 25 for leading the toner into the image forming device. One or more paddles or other toner moving mechanisms (not illustrated) may be positioned within the reservoir 25 for agitating and/or moving the toner to the outlet 26.

The cartridge 10 is removably connected to the image forming device 100. Removal of the cartridge 10 may be necessary for various reasons, including depletion of the toner from the reservoir 25, and initial shipping of the image forming device 100. During installation, the cartridge 10 is moved in a cartridge insertion direction illustrated by arrow A in FIGS. 1 and 2. This direction is substantially through the top and bottom sides 21, 22 to engage the electrical connector 30 mounted on the bottom side 22. The size and shape of the body 20 obscures the electrical connector 30 from the view of the user who is normally grasping the handle 23 during insertion of the cartridge 10.

Figure 3:
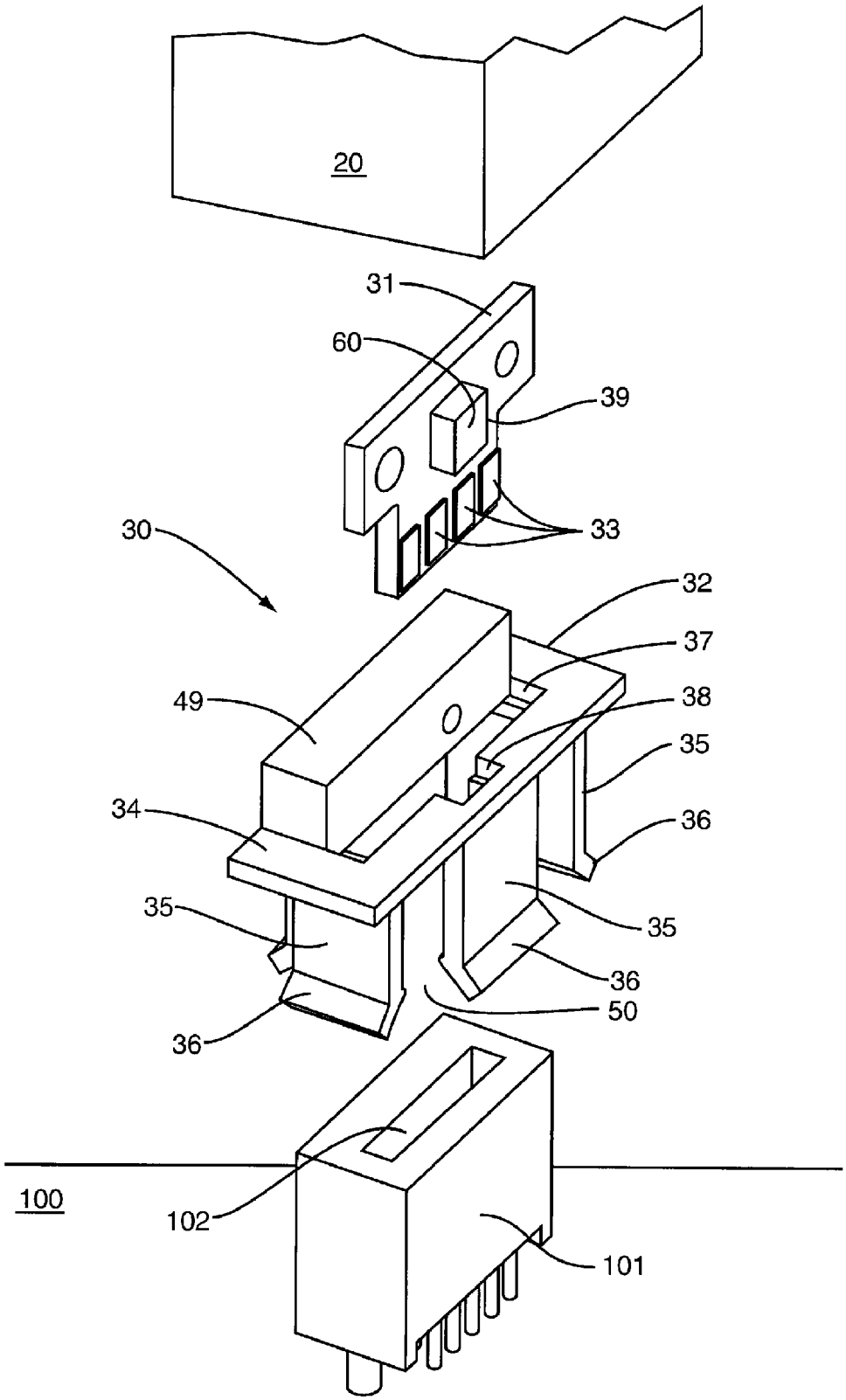
FIG. 3 is an exploded view of an electrical connector and a connector on an image forming device according to one embodiment.

The electrical connector 30 is movably connected to the body 20. FIG. 3 illustrates an exploded view of an electrical connector 30 that includes a circuit board 31 and a housing 32. The circuit board 31 includes one or more electrical contacts 33. In one embodiment as illustrated in FIG. 3, the electrical contacts 33 are positioned at a bottom side of the circuit board 31. Circuit board 31 may further include computing hardware, schematically illustrated as 60, for storing cartridge parameters including but not limited to pages printed, toner color, first use date, and cartridge ID. Computing hardware 60 may be positioned within a shell 39. The computing hardware 60 may include one or more processors, logic devices, and memory. The computing hardware may further comprise integrated circuits, including for example application specific integrated circuits and digital signal processors, in which embedded program code may be stored and executed.

Housing 32 is constructed to position the circuit board 31 for engaging with a connector 101 within the image forming device 100. Housing 32 includes a base 34 with one or more outwardly-extending arms 35. Base 34 includes an opening 37 sized to receive the circuit board 31. A member 49 may be positioned adjacent to the opening 37 to support the circuit board 31 when attached to the housing 32. In one embodiment, opening 37 includes a notch 38.

One or more arms 35 extend outward from the base 34 in a cantilever manner. The arms 35 may be rigid or may be flexible relative to the base 34. In one embodiment, four arms extend from the base 34 and each is flexible. In another embodiment, multiple arms 35 extend from the base 34 with some one or more of the arms 35 being flexible and the others being rigid. The arms 35 form a receptacle 50 sized to extend around the entirety or a portion of the connector 101. One or more of the arms 35 may further include a flared end 36 to facilitate engagement with the connector 101 of the image forming device 100. FIG. 3 illustrates an embodiment with each of four arms 35 including flared ends 36. In one embodiment, the inner edges of the arms 35 are substantially smooth to facilitate sliding contact during engagement with the connector 101.

Figure 4A:
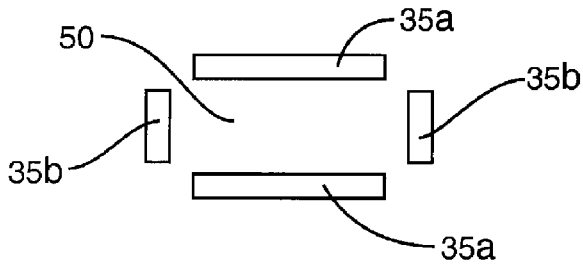
FIG. 4A is a bottom view of a receptacle of the electrical connector according to one embodiment.
Figure 4B:
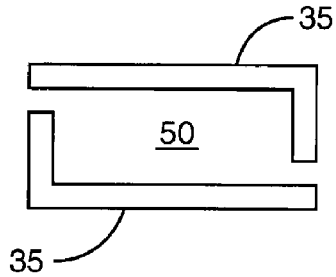
FIG. 4B is a bottom view of a receptacle of the electrical connector according to one embodiment.
Figure 4C:
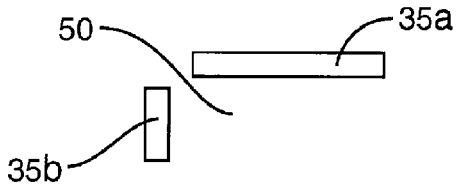
FIG. 4C is a bottom view of a receptacle of the electrical connector according to one embodiment.
Figure 4D:
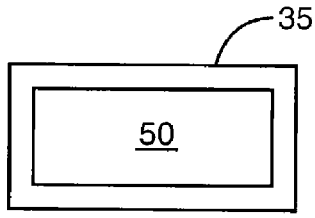
FIG. 4D is a bottom view of a receptacle of the electrical connector according to one embodiment.
Figure 4E:
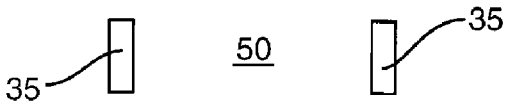
FIG. 4E is a bottom view of a receptacle of the electrical connector according to one embodiment.
Figure 4F:
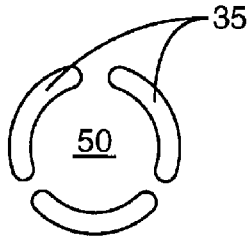
FIG. 4F is a bottom view of a receptacle of the electrical connector according to one embodiment.

Arms 35 may include a variety of shapes and configurations. FIG. 4A illustrates a bottom view of one embodiment with four separate discrete arms 35 separated by gaps. The arms 35 may be separated into a first pair of opposing arms 35*a* and a second pair of opposing arms 35*b*. Receptacle 50 is formed between the opposing arms 35*a*, 35*b*. The configuration of FIG. 4A coincides with the embodiment of the arms 35 illustrated in FIG. 3. FIG. 4B illustrates another embodiment with first and second arms 35 each including a discrete length and being separated by gaps. FIG. 4C illustrates an embodiment with two arms 35 that form a corner of a receptacle to receive the connector 101. FIG. 4D illustrates an embodiment with a single contiguous arm 35 that forms and extends around the receptacle 50. FIG. 4E illustrates an embodiment with two opposing arms 35 that form a receptacle 50 therebetween to receive the connector 101. The receptacle 50 may include a variety of shapes that conforms to the connector 101. In one embodiment as illustrated in FIGS. 4A-4E, receptacle 50 is substantially rectangular. FIG. 4F illustrates a substantially circular receptacle 50.

Figure 5B:
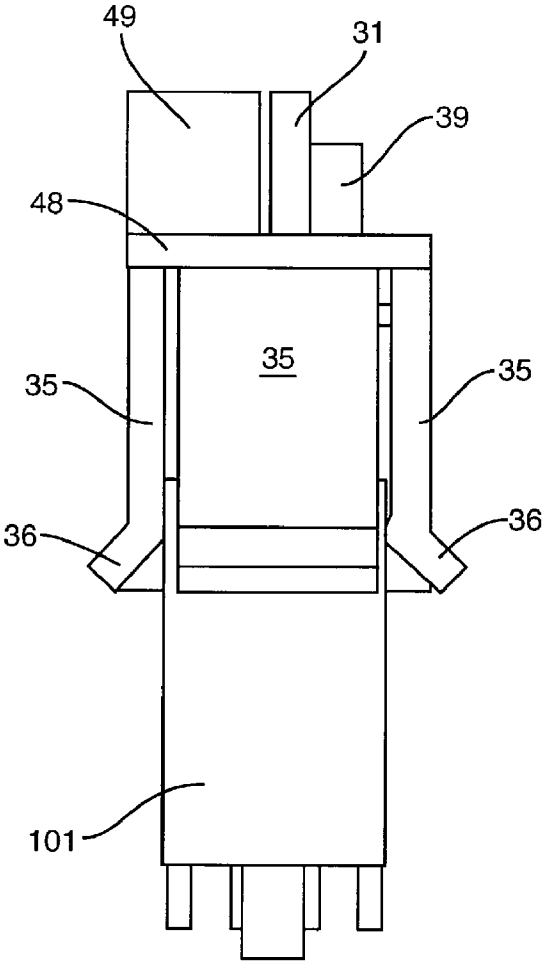
FIG. 5B is a side view of the electrical connector of FIG. 5A.
Figure 5A:
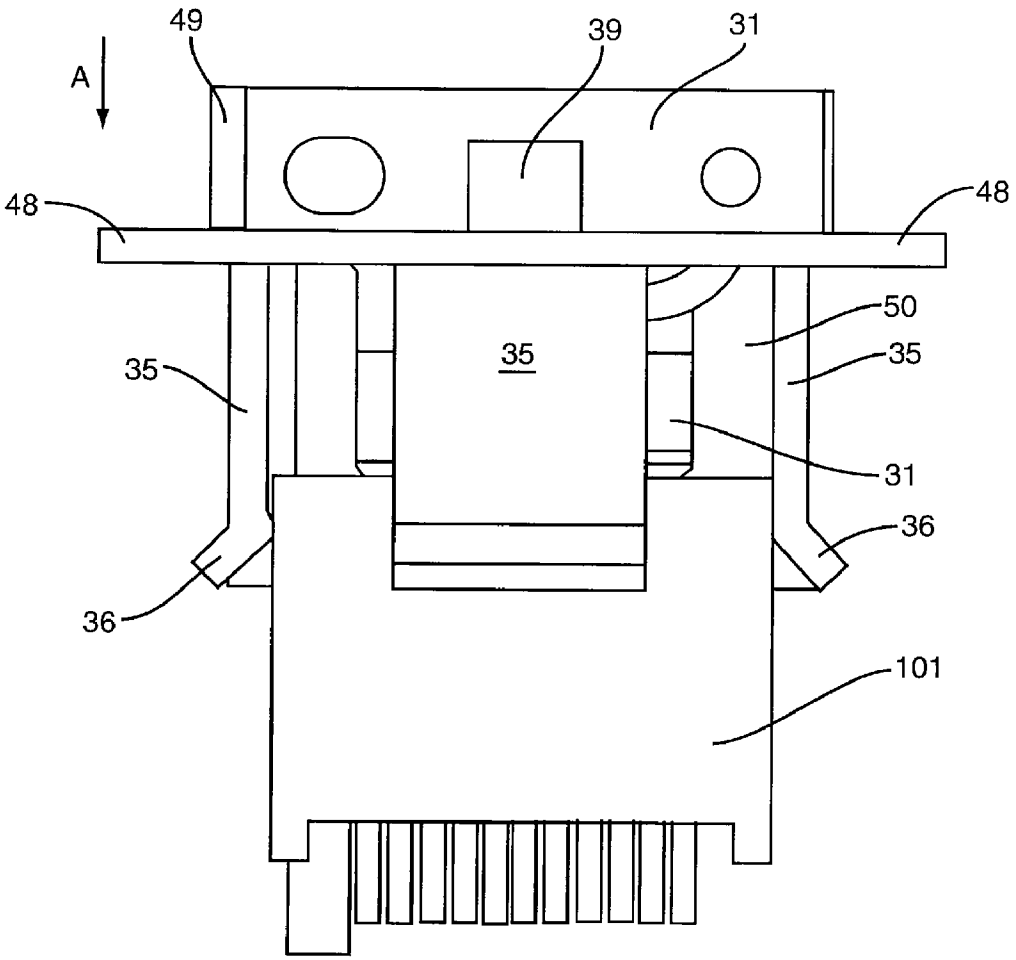
FIG. 5A is a front view of an electrical connector partially engaged with a connector on an image forming device according to one embodiment.

FIGS. 5A and 5B illustrate the electrical connector 30 partially engaged with the connector 101. The receptacle 50 formed by the arms 35 is sized to receive the connector 101. In this embodiment, the inner sides of the arms 35 are substantially smooth to facilitate sliding movement of the arms 35 along the outer edges of the connector 101. The arms 35 act as a guide to position the circuit board 31 relative to the connector 101. With the arms 35 in contact with the connector 101, the circuit board 31 is guided into the opening 102 in the connector 101. The electrical contacts 33 contact corresponding contacts in the opening 102 to form the communication path between the cartridge 10 and the device 100.

The electrical connector 30 may be positioned to be visually obscured by the body 20. By way of example and using FIG. 1, the electrical connector 30 may be positioned on or towards the bottom 22 of the body 20. During insertion, the user may not be able to visually see the position of the electrical connector 30 relative to the connector 101 in the image forming device 100. The movable nature of the electrical connector 30 allows for some room for error in the event the body 20 is not precisely inserted into the device 100. The construction of the connector 30 causes the circuit board 31 to be accurately seated within the connector 101 when the cartridge 10 is fully inserted into the device 100. Further, the user understands without visual confirmation that the circuit board 31 is accurately seated when the cartridge 10 is inserted within the device 100. In one embodiment, insertion of the body 20 also causes tactile feedback to the user to further emphasize that the circuit board 31 is accurately seated.

In one embodiment as illustrated in FIGS. 5A and 5B, the circuit board 31 is recessed within the housing 32. Specifically, an outer edge of the circuit board 31 is positioned inward from the outer edges of the arms 35. This causes the outer edges of the arms 35 to initially contact the connector 101 and align the electrical connector 30. After the initial contact and alignment, additional movement in the insertion direction A causes the circuit board 31 to engage within the opening 102. Embodiments of electrical connectors are disclosed in U.S. patent application Ser. No. 11/554,117 entitled "Electrical Connectors for Toner Cartridges in an Image Forming Device".

The electrical connector 30 is movably connected to the body 20. In one embodiment, a retainer 40 is positioned on the body 20 to receive the electrical connector 30. The retainer 40 may be formed by the body 20, or may be a separate element that is attached to the body 20. FIG. 2 illustrates one embodiment of a retainer 40 formed by the body 20. Retainer 40 includes a slot 42 formed between a pair of spaced apart members 41. Retainer 40 forms a space with a width w to receive the electrical connector 30. The width w is greater than a width of the electrical connector 30 formed either between opposing arms 35, or opposing edges of the member 49. This size difference allows for the electrical connector 30 to move laterally as indicated by arrow B within the space formed by the retainer 40.

In one embodiment, the amount of lateral movement of the electrical connector 30 is dictated by the size of the arms flared ends 36. During insertion, the flared ends 36 may contact the connector 101. If the electrical connector 30 is not aligned, the flared ends cause the connector 30 to move laterally and align with the connector 101.

The housing 32 may further include wings 48 that laterally extend outward to fit within the slot 42. A width of the wings 48 is less than a width s of the slot 42 thus providing for longitudinal motion of the electrical connector 30 relative to the body 20. This longitudinal motion is substantially perpendicular to the lateral motion previously explained.

Figure 6:
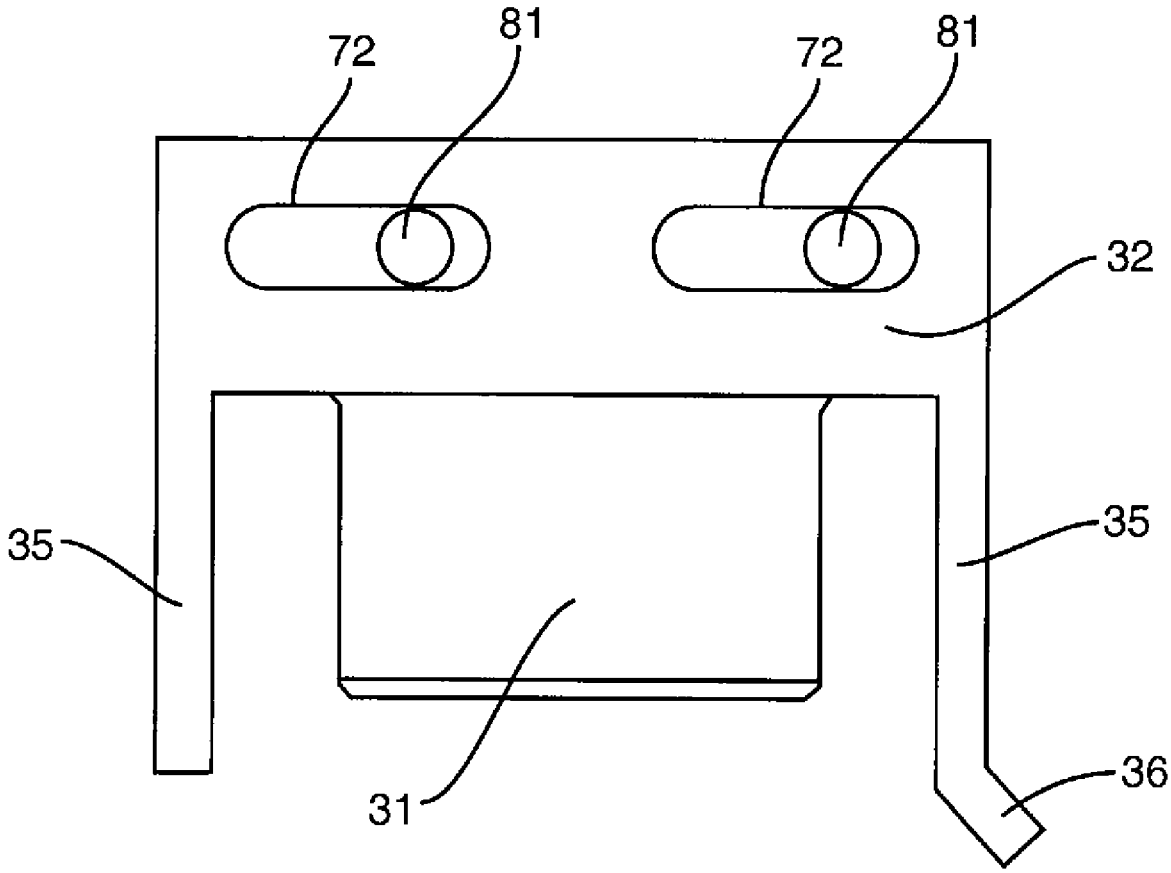
FIG. 6 is a side view of an electrical connector according to one embodiment.

FIG. 6 illustrates another embodiment with the housing 32 including a pair of elongated slots 72. Pins 81 that extend from the body 20 are positioned within the slots 72 to connect the electrical connector 30 to the body 20. The elongated slots 72 include a greater width than the pins 81 to provide for lateral movement during cartridge insertion. The relative sizes of the slots 72 and pins 81 may also provide for longitudinal movement.

Figure 7:
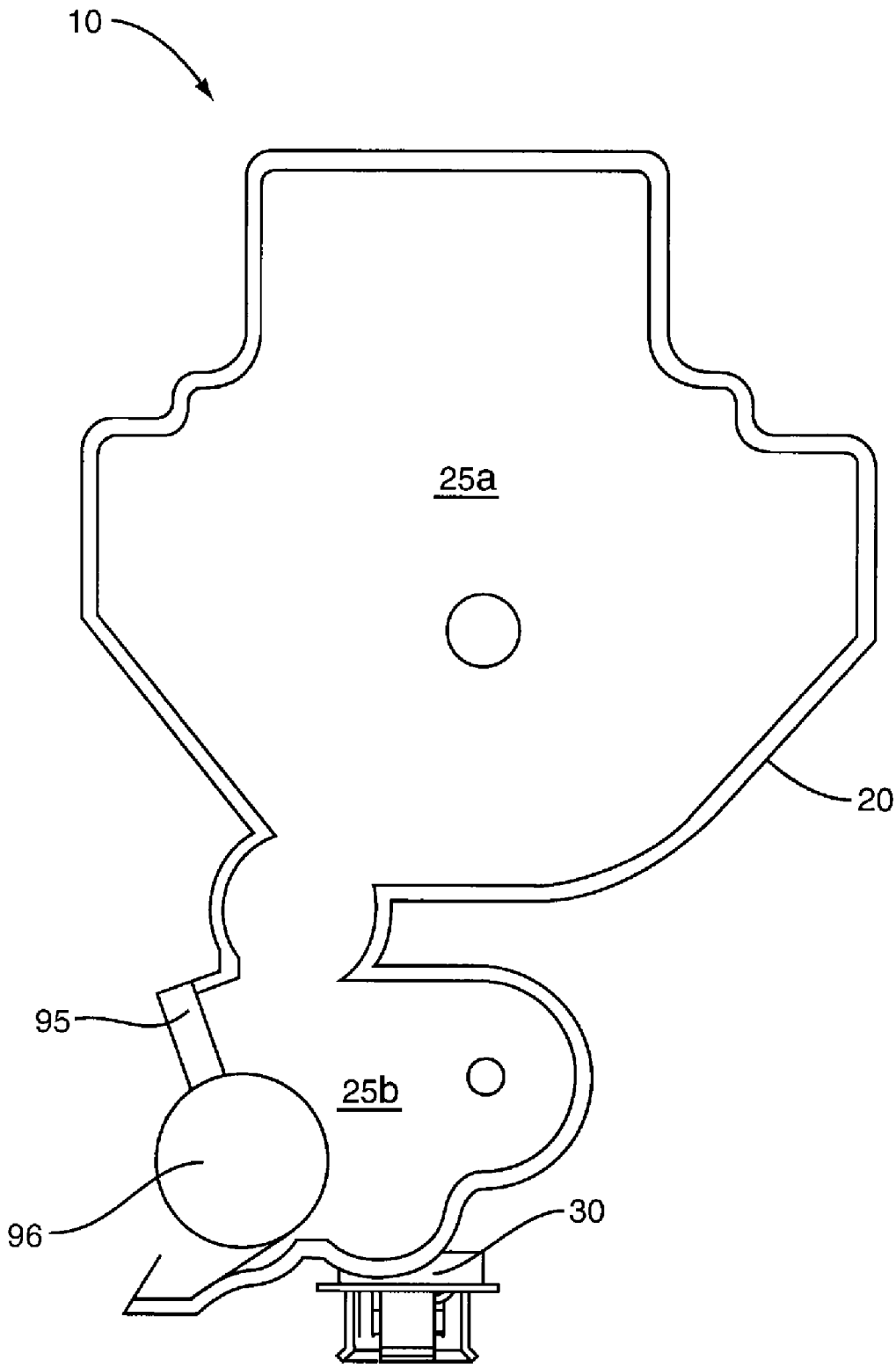
FIG. 7 illustrates a schematic view of a cartridge with a body and an electrical connector according to one embodiment.
Figure 8:
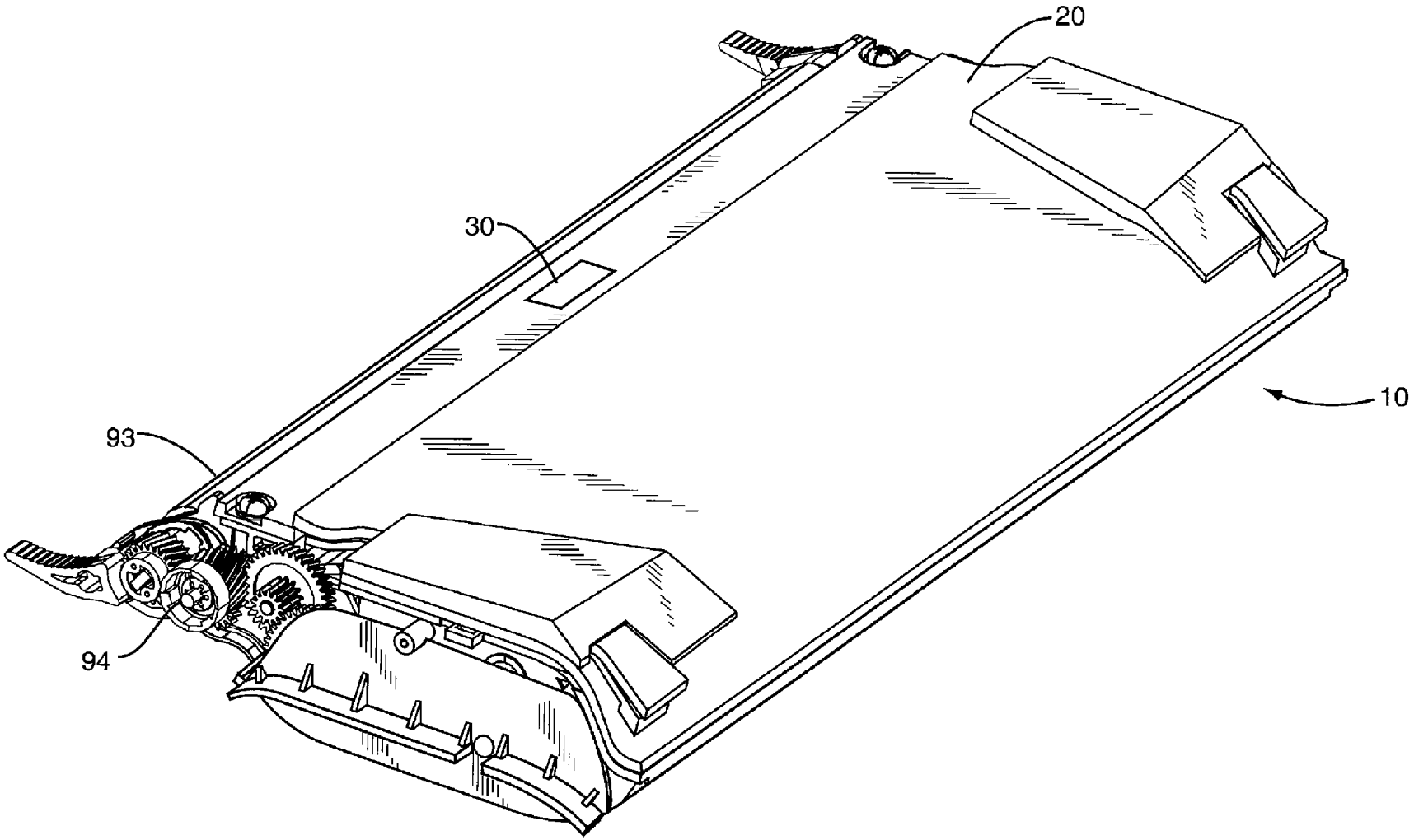
FIG. 8 illustrates a schematic view of a cartridge with a body and an electrical connector according to one embodiment.

The electrical connector 30 may be used with a variety of different cartridge bodies 20. FIG. 2 illustrates an embodiment with the body 20 including reservoir 25 for containing the toner. FIG. 7 includes an embodiment with the electrical connector 30 connected to an exterior of body 20. The body 20 includes a pair of reservoirs 25*a*, 25*b*, a developer roll 96, and toner regulating member 95. FIG. 8 illustrates the electrical connector 30 positioned on an exterior of a body 20 sized to include a photoconductive member 93, gears 94, as well as internal developer roll, toner reservoir, and agitation members (not illustrated).

Figure 9:
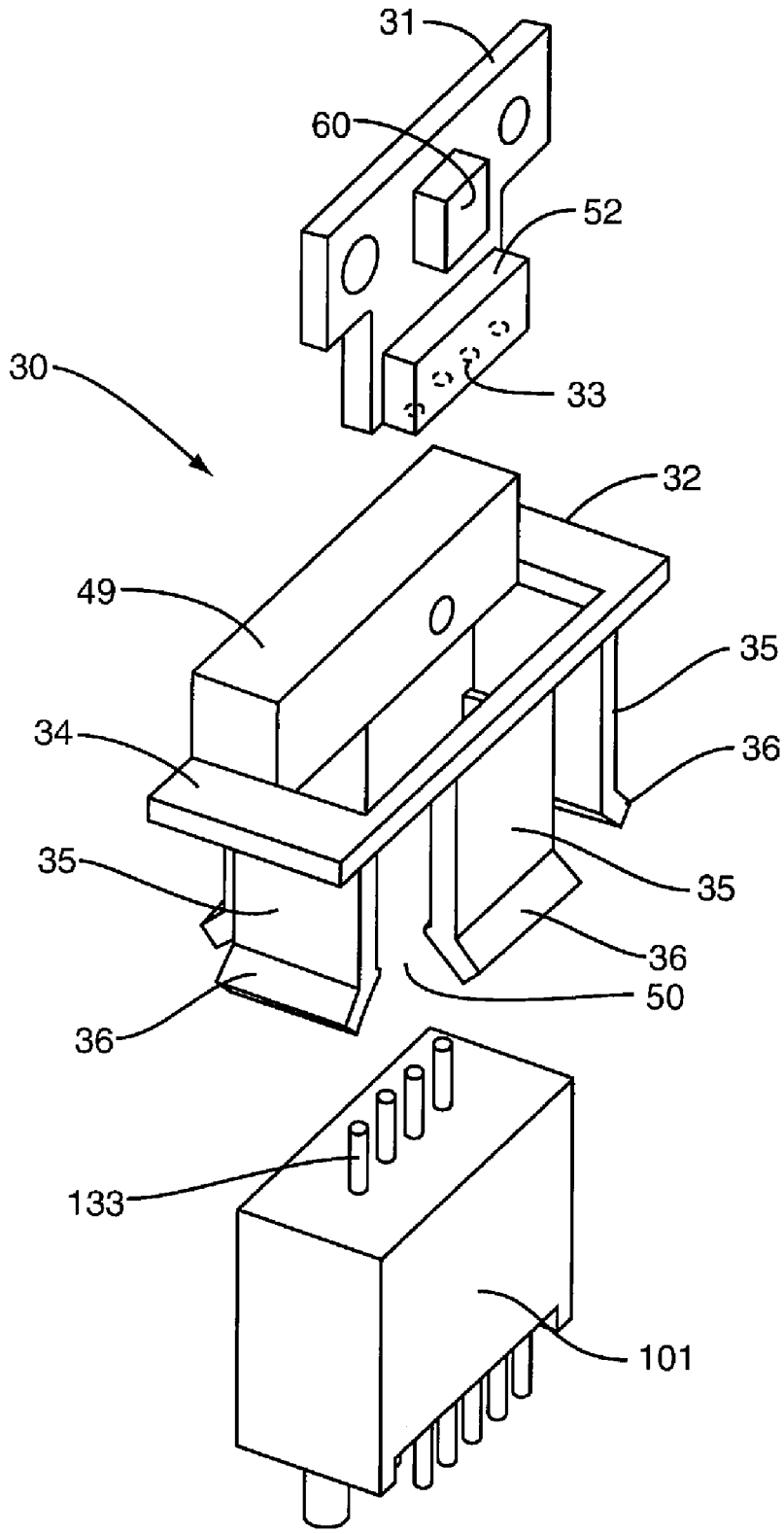
FIG. 9 is an exploded view of an electrical connector and a connector on an image forming device according to one embodiment.

In embodiments described above, the circuit board 31 includes exposed contacts 33 that engage contacts in the opening 102 of connector 101 to form the communication path between the cartridge 10 and the device 100. As described, the connector 101 in the image forming device 100 is a female connector that engages a male circuit board 31. Those skilled in the art should appreciate that other types of connector configurations may be implemented. For example, FIG. 9 depicts an exploded view of an electrical connector 30 that includes a circuit board 31 and a housing 32 as described above. In the present embodiment, the circuit board 31 includes computing hardware 60 that is electrically coupled to a connector 52. In the illustrated embodiment, the connector 52 includes one or more female electrical contacts 33 configured to engage corresponding male contacts (e.g., pins) 133 in connector 101. In another unillustrated embodiment, the circuit board 31 may include a connector 52 with male contacts 33 that engages a connector 101 with female contacts 133 in the image forming device 100.

Figure 10:
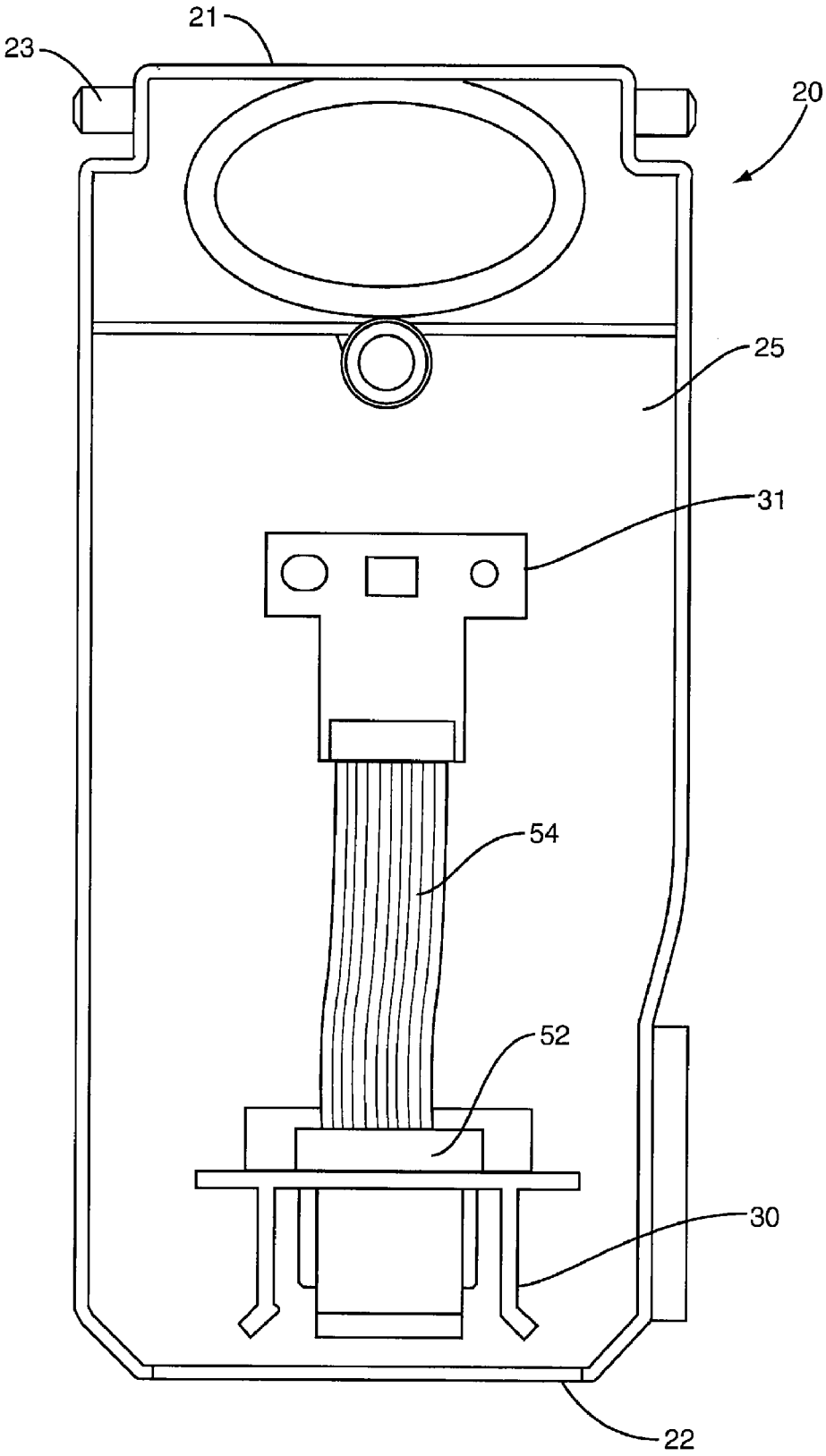
FIG. 10 is a schematic view of a cartridge according to one embodiment.

In an embodiment illustrated in FIG. 10, the circuit board 31 is positioned away from the electrical connector 30. In contrast with previously described embodiments, the circuit board 31 may be securely fixed to the cartridge body 20. The circuit board 31 may be connected electrically via a flexible cable 54 to a connector 52 that is secured to the electrical connector 30. Consequently, the connector 52 is movable along with the electrical connector 30 to engage the mating connector 101 while the circuit board 31 remains substantially fixed.

The cartridge 10 of the present application may be used in a variety of image forming devices. The embodiments described above include laser image forming devices including but not limited to printers, facsimile machines, copiers, and combinations. One embodiment of an image forming device is disclosed in U.S. patent application Ser. No. 11/407,307 filed on Apr. 19, 2006 and entitled "Architecture for an Image Forming Device" which is herein incorporated by reference. In another embodiment, the cartridge 10 is constructed to contain ink that is usable in an ink jet printing device.

The embodiments disclosed above include a toner cartridge 10 with a movable electrical connector 30. The electrical connector 30 may also be movably positioned to other elements that are inserted and/or replaced within the image forming device 100. Other elements include but are not limited to a fuser assembly, a developer assembly, and an intermediate transfer belt assembly. The electrical connector 30 on each of these elements is movable to align with an engage a corresponding connector within the image forming device 100.

Spatially relative terms such as "under", "below", "lower", "over", "upper", and the like, are used for ease of description to explain the positioning of one element relative to a second element. These terms are intended to encompass different orientations of the device in addition to different orientations than those depicted in the figures. Further, terms such as "first", "second", and the like, are also used to describe various elements, regions, sections, etc and are also not intended to be limiting. Like terms refer to like elements throughout the description.

As used herein, the terms "having", "containing", "including", "comprising" and the like are open ended terms that indicate the presence of stated elements or features, but do not preclude additional elements or features. The articles "a", "an" and "the" are intended to include the plural as well as the singular, unless the context clearly indicates otherwise.

The present invention may be carried out in other specific ways than those herein set forth without departing from the scope and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A toner cartridge for use within an image forming device, the toner cartridge comprising:

a body with an interior reservoir to contain toner, the body comprising a top side and a bottom side;

a retainer formed by the body;

an electrical connector captured by the retainer and operatively connected to the bottom side of the body, the electrical connector including a receptacle with an open space to engage with the image forming device, the electrical connector being movable relative to the body in a plane substantially perpendicular to a cartridge insertion direction; and an outlet in communication with the interior reservoir to move the toner from the interior reservoir, the outlet positioned vertically above the electrical connector.

2. The toner cartridge of claim 1, wherein the body includes a cavity sized to contain the electrical connector.

3. The cartridge of claim 1, wherein the electrical connector is completely contained within a cavity.

4. The cartridge of claim 1, wherein the electrical connector includes a circuit board and a housing.

5. The cartridge of claim 1, wherein the electrical connector includes a plurality of electrical contacts oriented substantially parallel to the cartridge insertion direction.

6. A toner cartridge for use within an image forming device, the toner cartridge comprising:

a body with an interior reservoir to contain toner, the body comprising a top side and a bottom side;

a cavity formed in the bottom side of the body;

a housing movably connected to the body and positioned within the cavity;

a circuit board fixedly attached to the housing; and an outlet in communication with the interior reservoir to move the toner from the interior reservoir, the outlet positioned between the housing with the attached circuit board and the top side of the body;

the housing and circuit board being movable relative to the body during insertion of the toner cartridge into the image forming device.

7. A toner cartridge for use within an image forming device, the toner cartridge comprising:

a body with a top side, a bottom side, and an intermediate side that extend around an interior reservoir that contains toner, the body including a cavity extending into the bottom side, the body further including an outlet to move the toner from the interior reservoir; and an electrical connector operatively connected to the body and positioned within the cavity, the electrical connector including a circuit board that engages with the image forming device during insertion of the toner cartridge, the electrical connector positioned at a different vertical level on the body than the outlet to be in non-overlapping arrangement;

the electrical connector being movably positioned within the cavity.

8. The toner cartridge of claim 7, wherein the electrical connector extends outward beyond the cavity.

9. The cartridge of claim 7, wherein the circuit board extends outward beyond the cavity.

* * * * *

UNITED STATES PATENT AND TRADEMARK OFFICE
Certificate

Patent No. 7,272,336 B1 Patented: September 18, 2007

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Jedediah Taylor Dawson, Lexington, KY (US); Akash Chaudhuri, Lexington, KY (US); Darin M. Gettlefinger, Lexington, KY (US); and Gregory A. Cavill, Winchester, KY (US).

Signed and Sealed this Twelfth day of May 2009.

DAVID M. GRAY
*Supervisory Patent Examiner*
Art Unit 2852